US005697231A

United States Patent [19]

Tobin, Jr.

[11] Patent Number: 5,697,231

[45] Date of Patent: Dec. 16, 1997

[54] SWIVELING HANDCUFF

[75] Inventor: Thomas H. Tobin, Jr., Fond du Lac, Wis.

[73] Assignee: Tobin Tool & Die Company, Fond du Lac, Wis.

[21] Appl. No.: 542,802

[22] Filed: Oct. 13, 1995

[51] Int. Cl.[6] ..... E05B 75/00

[52] U.S. Cl. ..... 70/16; 403/56

[58] Field of Search ..... 70/16, 14–15, 70/17; 403/56

[56] References Cited

U.S. PATENT DOCUMENTS

| | | | |
|---|---|---|---|
| 443,769 | 12/1890 | Hurford | 403/56 |
| 1,579,333 | 4/1926 | Neal | 70/16 |
| 2,759,348 | 8/1956 | McKee | 70/16 |
| 4,300,368 | 11/1981 | Sullivan | 70/16 |
| 4,461,284 | 7/1984 | Fackler | 403/56 |
| 4,471,595 | 9/1984 | Lanzafame | 403/56 |
| 4,652,166 | 3/1987 | Gautron | 403/56 |
| 4,697,441 | 10/1987 | Allen | 70/16 |

FOREIGN PATENT DOCUMENTS

| | | | |
|---|---|---|---|
| 2518622 | 6/1983 | France | 70/16 |
| 247666 | 6/1912 | Germany | 70/16 |
| 6808902 | 12/1969 | Netherlands | 70/16 |
| 2005871 | 1/1994 | Russian Federation | 70/16 |

*Primary Examiner*—Darnell M. Boucher
*Attorney, Agent, or Firm*—Donald Cayen

[57] ABSTRACT

A swiveling handcuff comprises two generally conventional cuffs connected by one or more swivel links. Each swivel link has a pair of spherical lobes joined by a neck. The lobes are captured in respective cuffs. The swivel link provides three degrees of rotational freedom between the cuffs. The swivel links allow enough flexibility to reduce the possibility of injury to a restrained person but also provide enough rigidity to allow a good grip by a user when applying the swiveling handcuff. The swiveling handcuff provides protection for both the restrained person and the user.

8 Claims, 3 Drawing Sheets

SWIVELING HANDCUFF

BACKGROUND OF THE INVENTION

1. Field of the Invention

This invention pertains to physically constraining a person, and more particularly to apparatus that restrains a person's arms and hands.

2. Description of the Prior Art

The modern handcuff was developed almost one hundred years ago. It is comprised of two cuffs connected to each other. Each cuff has a frame with a concave surface. A bow having concave and convex surfaces is pivotally connected to the frame. The bow is pivotable in a first direction to place the cuff in a closed position. When the cuff is in the closed position, the bow cooperates with the frame to form a generally circular opening that can surround a person's wrists. When the cuff is closed, teeth on the bow convex surface engage a locking mechanism in the frame. The locking mechanism prevents reverse rotation of the bow until the cuff is unlocked with a key. The locking mechanism usually includes a double lock that prevents the bow from pivoting further in the first direction from an initial closed position. The double lock is important to prevent injury to the person's wrists.

The normal method of applying a handcuff to a person is to apply one cuff to one of the person's wrists while the person has his hands behind his head. The person's arms are then lowered together behind his back, and the second cuff is applied to the second wrist. When the cuffs are applied, they must be oriented such that their keyholes face outwardly from the person's body.

In some handcuffs, the two cuffs are connected to each other by a few links of chain and a pair of eye bolts. That design has the advantage of providing maximum freedom of movement between the cuffs. The eye bolts rotate in the cuffs and allow the cuffs to swivel through 360 degrees relative to each other. The cuffs can also be moved linearly toward and away from each other. Consequently, there is a relatively great amount of movement available to the cuffs to accommodate the position of the person's wrists when the cuffs are applied. Similarly, a person restrained by the chain-link cuffs can exercise relatively large amounts of movement between his wrists.

On the other hand, the chain-link handcuff has three drawbacks. The first is that the chain is too flexible. The handcuff is difficult to control by a police officer when he applies it to a person. The officer must hold both cuffs in one hand, separated from each other and in a proper orientation relative to each other, with the chain stretched across his palm. The chain is uncomfortable to grip, which results in less control of the cuffs. The second drawback is that the flexibility of the chain can cause the cuffs to flop around, resulting in a longer time to apply the second cuff. The longer time to apply the second cuff endangers the safety of the officer. After the first cuff is applied, the other cuff must remain in the proper orientation to enable quick application. Maintaining proper orientation of the two cuffs when applying a chain-link handcuff is a difficult feat and requires considerable practice and training. The third disadvantage of the chain-link handcuff is that the chain can be used as a weapon to choke an officer.

To solve the problem of keeping the cuffs oriented relative to each other, it is known to connect them with a rigid handle. The handle is designed to be grasped in one hand of a police officer. After the officer has applied the first cuff, the second cuff is automatically oriented for quick application of the second cuff. The rigid handle cuff is comfortable to hold, and it provides maximum control to the officer.

However, the rigid handle handcuff possesses the problem of being too rigid. It allows no movement between the cuffs, thereby greatly reducing arm flexibility when the second cuff is applied. In addition, the fixed handle design allows too much leverage to be applied to the restrained person's arms. The combination of the limited arm motion and the added leverage can result in arm, wrist, and shoulder injuries to the restrained person.

Another design for connecting two cuffs employs a hinge that enables the cuffs to pivot relative to each other in a single degree of freedom. The hinge prevents any linear movement of the cuffs relative to each other. However, the hinge does allow the cuffs to fold through an angle of 180 degrees relative to each other between being in facing contact with each other and being coplanar.

The hinge type handcuff possesses the advantage of the rigid handle handcuff of providing a fixed orientation between the two cuffs when applying them. The hinge type handcuff also improves on the inflexibility of the rigid handle handcuff. Nevertheless, the hinge type design is still too rigid and allows too much leverage to be applied to the arms of the restrained person.

Thus, it is seen that the prior handcuffs were either too flexible or too rigid.

SUMMARY OF THE INVENTION

In accordance with the present invention, a swiveling handcuff is provided that allows enough flexibility to reduce the possibility of injury but is rigid enough to provide a good grip for applying to a person. This is accomplished by apparatus that includes one or more swivel links that connect the cuffs to each other.

Each cuff is comprised of two parallel plates separated by a divider. The plates have a generally rectangular section with a curved arm extending from an inside corner of the rectangular section. One end of a bow is pivotally connected between the plate arms at their distal ends. A second end of the bow curves back to engage a locking mechanism located between the rectangular sections of the two plates.

The divider is generally U-shaped. It has a middle leg that extends along the outside edges of the rectangular sections of the plates. The divider also has two side legs that extend along corresponding side edges of the rectangular sections of the plates. The locking mechanism is located in the space between the divider middle and side legs.

According to one aspect of the invention, the two cuffs of the swivelable handcuff are connected to each other by a swivel link. The swivel link is generally barbell shaped, having spherical lobes at each end joined by a neck. One lobe of the swivel link is captured in an enclosure in one of the cuffs, and the other lobe is captured in a similar enclosure in the other cuff. The enclosures are formed by the cooperation of the cuff plates and bulb-shaped slots in the dividers. The plates of each cuff are fabricated with respective slots having a width slightly greater than the size of the swivel link neck and a depth slightly less than the depth of the divider slot.

The swivel link enables the cuffs to rotate in three degrees of freedom relative to each other. The cuffs can rotate through 360 degrees about the longitudinal axis of the swivel link. The cuffs can also rotate about a first transverse axis to either fold against each other for storage or to be coplanar. The third degree of freedom is a rotation about a second transverse axis perpendicular to the first transverse axis. The three degrees of rotational freedom render the swiveling handcuff easy to apply while minimizing the risk of injury to the restrained person.

In another aspect of the invention, two or more swivel links are employed to connect the cuffs to each other. The multiple swivel links enable full rotation of the cuffs relative to each other about the first transverse axis between folded and coplanar positions. The multiple swivel links also provide for relative rotation of the cuffs about the second transverse axis and about the longitudinal axis. The amount of rotation about the longitudinal axis is controlled by the number of swivel links and by their spacing from each other.

The method and apparatus of the invention, using one or more swivel links to connect two cuffs, thus provides a user with flexibility, comfort, and control when restraining a person. The possibility of injuring the restrained person is small, even though the swivelable handcuff can be quickly oriented and applied.

Other advantages, benefits, and features of the present invention will become apparent to those skilled in the art upon reading the detailed description of the invention.

DETAILED DESCRIPTION OF THE PREFERRED EMBODIMENT

Figure 1:
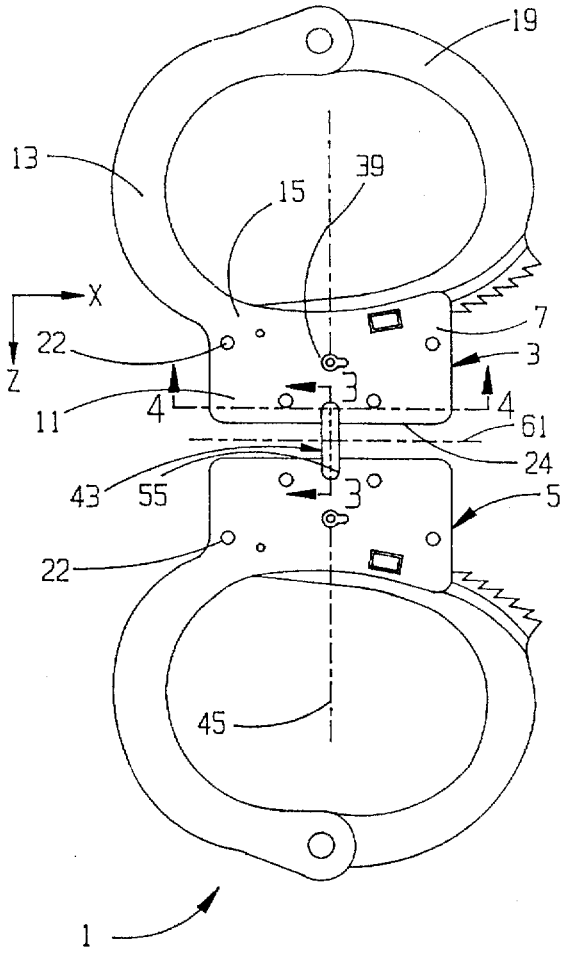
FIG. 1 is a front view of the swiveling handcuff of the invention.
Figure 2:
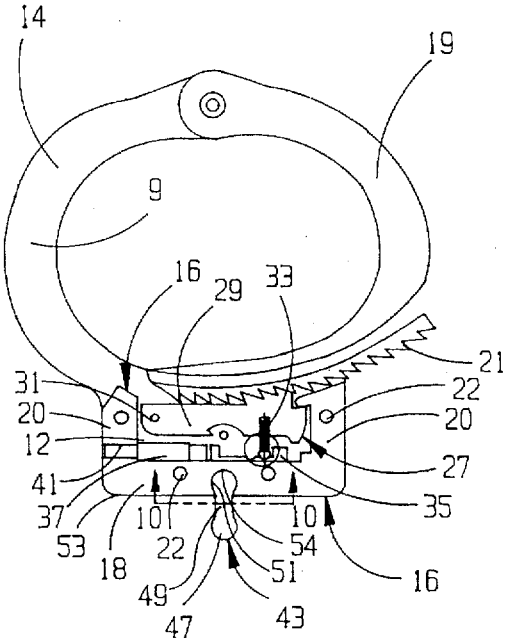
FIG. 2 is a front view of a cuff with the top plate thereof removed.
Figure 10:
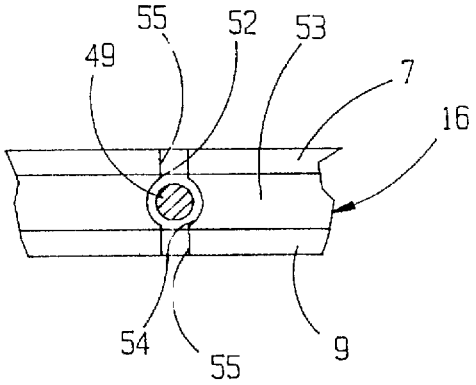
FIG. 10 is a view on an enlarged scale taken along line 10—10 of FIG. 2.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–5 and 10, a swiveling handcuff is illustrated that includes the present invention. The swiveling handcuff 1 includes two generally similar cuffs 3 and 5. The cuff 3 has a top plate 7 and a bottom plate 9. The top plate 7 has a rectangular section 11 and a curved arm 13 that extends from a corner region 15 of the rectangular section. The bottom plate 9 is constructed in a manner similar to the top plate, having a rectangular section 12 and a curved arm 14.

The rectangular sections 11 and 12 of the top and bottom plates 7 and 9, respectively, are spaced apart by a divider 16. The divider 16 is generally U-shaped, having a middle leg 18 and two side legs 20. The outside edge 53 of the divider middle leg 18 is coplanar with the outside edges 24 of the rectangular sections of the plates. The top and bottom plates and the divider are fastened together by rivets 22.

A cuff locking mechanism 27 is located between the plates 7 and 9 in the space between the legs 18 and 20 of the divider 16. The locking mechanism 27 includes a pawl 29 that is rotatable about a pin 31 that extends between the plates. A spring 33 urges teeth on the pawl 29 into engagement with teeth 21 on the bow 19. The locking mechanism further includes a double lock 35 that is actuated by a double lock pin 37. A key, not shown, is insertable through a keyhole 39 in the top plate 7 to operate the pawl and the double lock 35. The double lock is set by pushing a small pin on the key through a hole 41 in the divider and against the double lock pin 37.

In accordance with the present invention, the cuffs 3 and 5 are connected to each other by a swivel link 43. The swivel link 43 is in the shape of a barbell, having two spherical lobes 47 joined by a neck 49. The neck 49 is preferably cylindrical in shape. The swivel link defines a longitudinal or Z axis 45. The swivel link also defines an X axis 61 transverse to the Z axis 45, and a Y axis 62 transverse to both the Z and X axes.

To receive the swivel link 43, the divider 16 of each cuff 3, 5 is formed with a bulb-shaped slot 51 in the outside edge 53 of the divider middle leg 18. The slot 51 has an opening 52 at the divider outside edge that is slightly wider than the diameter of the swivel link neck 49. There is an arcuate cutout 54 on each side of the opening 52. The arcuate cutouts 54 have radii equal to the radius of the swivel link neck, FIG. 10. The slot has an arcuate end 54 with a radius slightly greater than the radius of the swivel link lobe 47.

Figure 3:
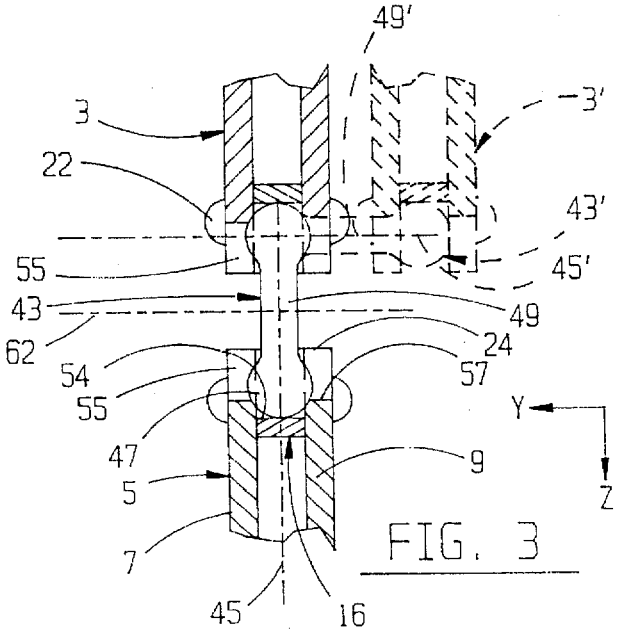
FIG. 3 is a cross sectional view on an enlarged scale taken along line 3—3 of FIG. 1.
Figure 5:
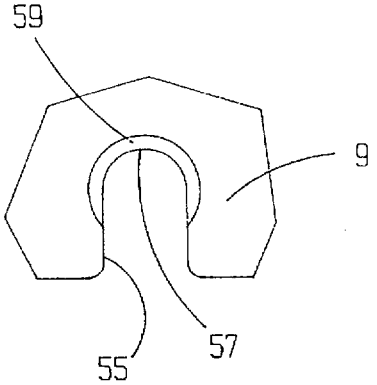
FIG. 5 is a view on a further enlarged scale taken along line 5—5 of FIG. 4, but with the swivel link removed.
Figure 4:
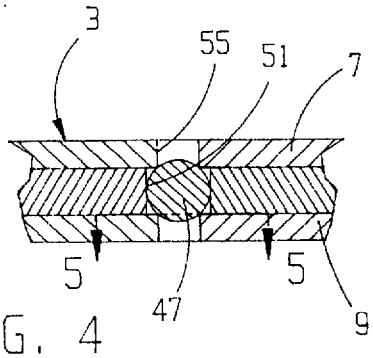
FIG. 4 is a cross sectional view on an enlarged scale taken along line 4—4 of FIG. 1.

The plates 7 and 9 are fabricated with respective slots 55 in their edges 24. The slots 55 have widths that are slightly greater than the diameter of the swivel link neck 49. The ends 57 of the slots 55 are round. As best shown in FIG. 3, the depth of the plate slots is slightly less than the depth of the divider slots 51. There is a countersink 59 around each plate slot end 57, FIG. 5.

The swivel link 43 is assembled to a cuff 3 or 5 by placing the swivel link lobe 47 in the divider slot 51. The top and bottom plates 7 and 9, respectively, are then placed over opposite sides of the divider 16. The rivets 22 hold the cuff components together. The divider slot and the plates adjacent their slots cooperate to form an enclosure that captures the swivel link lobe in place. The countersink 59 aids in nesting the swivel link between the plates.

The swivel link 43 enables the cuffs 3 and 5 of the swiveling handcuff 1 to have three degrees of rotational freedom between them. In FIGS. 1 and 3, the cuffs are shown in a coplanar position with the swivel link lying in the same general plane as the cuffs. From the coplanar position, each cuff is capable of rotating 90 degrees in both directions about the transverse X axis 61. Such rotation is possible because of the plate slots 55, which receive the swivel link neck 49. Consequently, the swivel handcuff can be folded for storage as is shown by the phantom lines 3' of FIG. 3. In the folded position, the cuffs are generally parallel to each other and perpendicular to the longitudinal or Z axis 45' of the rotated swivel link 43'. The length of the swivel link is chosen such that the heads of the rivets 22 do not interfere with the folding of the swiveling handcuff.

When the cuffs 3 and 5 are in the coplanar position of FIGS. 1 and 3, the cuffs are also capable of 360 degrees relative rotation about the Z axis 45. Such rotation constitutes the second degree of rotational freedom of the swiveling handcuff 1.

Figure 6:
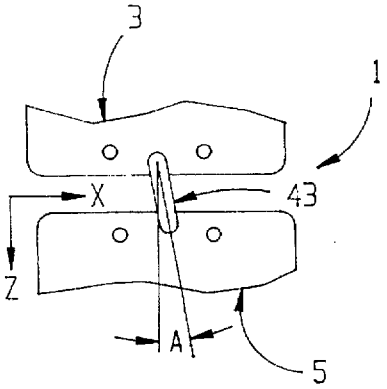
FIG. 6 is a partial view generally similar to FIG. 1 showing the rotational motion available between two cuffs about a Y axis.

FIG. 6 shows the third degree of rotational freedom between the cuffs 3 and 5. That rotation is about the transverse Y axis 62. The arcuate cutouts 54 in the outside edges 53 of the dividers 16 allow the swivel link 43 to rotate through an angle A of approximately ten degrees in both directions when the cuffs are coplanar.

Figure 7:
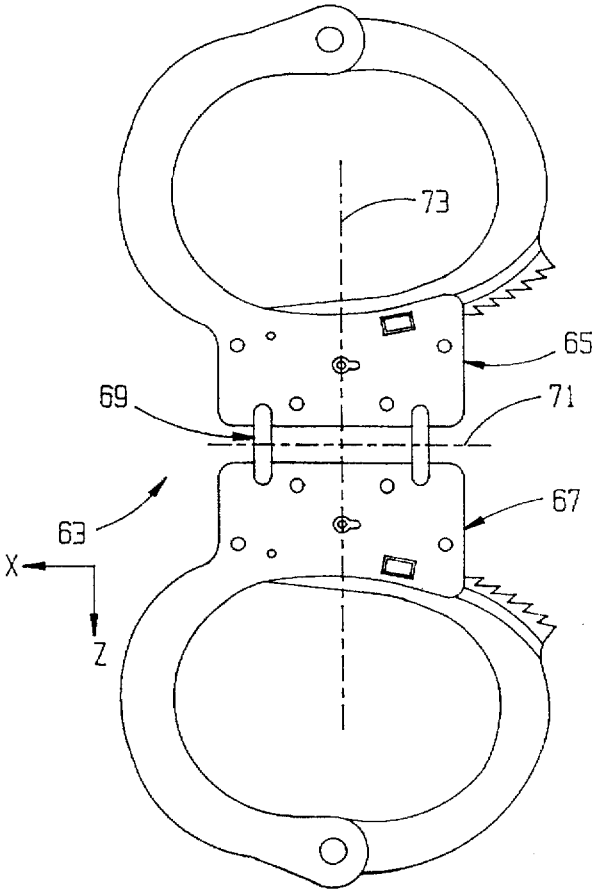
FIG. 7 is a view similar to FIG. 1, but showing a swiveling handcuff having two swivel links.

Further in accordance with the present invention, more than one swivel link can be incorporated into the swiveling handcuff. Looking at FIG. 7, a swiveling handcuff 63 has cuffs 65 and 67 that are similar to the cuffs 3 and 5, respectively, of the swiveling handcuff 1 of FIGS. 1–5. The cuffs 65 and 67 are connected by two swivel links 69 that are spaced apart along the X axis 71. The two swivel links 69 can be identical to the swivel links 43 described previously.

Figure 8:
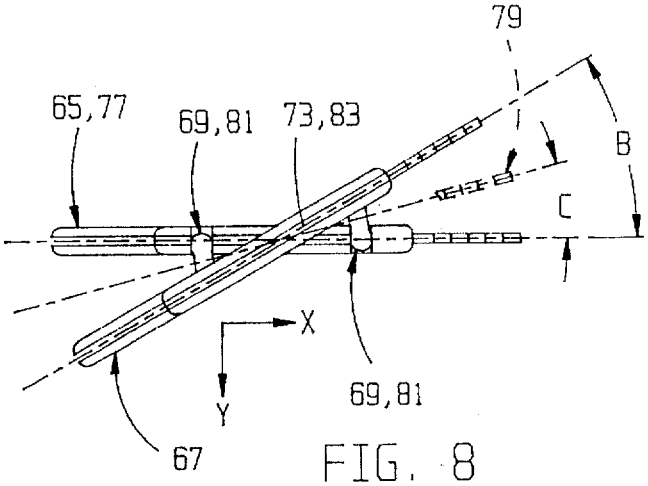
FIG. 8 is an end view of the swiveling handcuff showing the rotational motion available about a Z axis for the swiveling handcuff of FIGS. 7 and 9.

The two swivel links 69 enable the cuffs 65 and 67 of the swiveling handcuff 63 to be rotated about the X axis 71 to a folded position as was described in conjunction with FIG. 3. As best shown in FIG. 8, the two cuffs 65 and 67 are also capable of rotation in both directions about a longitudinal or Z axis 73 through an angle B. The amount of rotation about the Z axis 73 is governed by the distance between the swivel links 69. A distance between the swivel links 69 of approximately 1.18 inches works very well and allows a rotation through an angle B of approximately 30 degrees in each direction. The swiveling handcuff 63 is also capable of rotation about the Y axis through the angle A as shown in FIG. 6.

Figure 9:
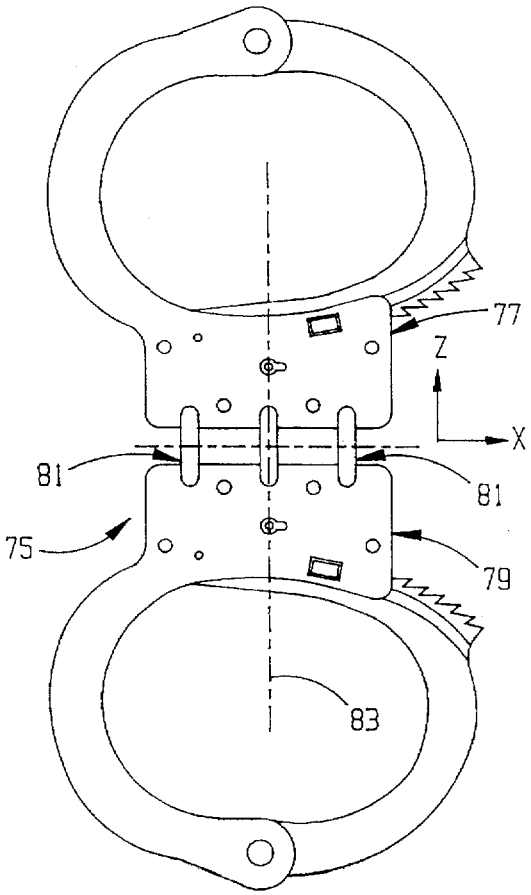
FIG. 9 is a view similar to FIG. 1, but showing a swiveling handcuff having three swivel links.

FIG. 9 shows a swiveling handcuff 75 having cuffs 77 and 79 connected by three swivel links 81. The construction and operation of the swiveling handcuff 75 are substantially similar to those of the swiveling handcuff 63 described previously. The swiveling handcuff 75 has the same rotational abilities about the X and Y axes as the swiveling handcuff 63. The rotation about the Z axis 83 is through an angle C in both directions, as is shown in FIG. 8. The three swivel links 89 allow rotation through an angle C of approximately 15 degrees.

In summary, the results and advantages of handcuffs can now be more fully realized. The swiveling handcuffs 1, 63, and 75 of the invention provide all the required components of conventional handcuffs with the added protection of greater safety for both a user who applies the handcuffs and a person being restrained. This desirable result comes from using the combined functions of the swivel links 43, 69, or 81. The swivel links firmly connect the individual cuffs to each other while allowing three degrees of rotational freedom between them. The cuffs can be folded about a first axis for storage. They also are capable of relative rotation about two other axes. If one swivel link is used, the cuffs are capable of 360 degree rotation about the swivel link longitudinal axis.

It will also be recognized that in addition to the superior performance of the swiveling handcuff of the invention, its construction is such as to cost little, if any, more than traditional handcuffs. Also, since the swivel links and the cuffs employ a simple design and are made of rugged components, the swiveling handcuff will provide long service life with minimal maintenance.

Thus, it is apparent that there has been provided, in accordance with the invention, a swiveling handcuff that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A swiveling handcuff comprising:

(a) a first generally planar cuff comprising:
  (i) a pair of first plates;
  (ii) a first divider interposed between the first plates;
  (iii) a first bow pivotally connected between the first plates; and
  (iv) first lock means for selectively locking and unlocking the first bow;

(b) a second generally planar cuff comprising:
  (i) a pair of second plates;
  (ii) a second divider interposed between the second plates;
  (iii) a second bow pivotally connected between the second plates; and
  (iv) second lock means for selectively locking and unlocking the second bow; and (c) at least one swivel link comprising:
  (i) a first spherical lobe captured in the first plates and divider of the first cuff;
  (ii) a second spherical lobe captured in the second plates and divider of the second cuff; and
  (iii) a neck joining the first and second lobes, wherein there are at least two swivel links captured in the first and second cuffs to connect the first and second cuffs to each other and to provide three degrees of rotational freedom between the first and second cuffs.

2. The swiveling handcuff of claim 1 wherein:

(a) the swivel links define respective longitudinal axes;

(b) the first and second cuffs are rotatable to a coplanar position whereat the first and second cuffs are generally coplanar with the swivel links longitudinal axes; and (c) the first and second cuffs are rotatable through an angle of approximately 60 degrees relative to each other about a longitudinal axis parallel to the longitudinal axes of the swivel links.

3. The swiveling handcuff of claim 1 wherein:

(a) there are three swivel links captured in the first and second cuffs to connect the first and second cuffs to each other and to provide three degrees of rotational freedom between the first and second cuffs;

(b) the swivel links define respective longitudinal axes;

(c) the first and second cuffs are rotatable to a coplanar position whereat the first and second cuffs are generally coplanar with the swivel links longitudinal axes; and (d) the first and second cuffs are rotatable through an angle of approximately 30 degrees relative to each other about a longitudinal axis parallel to the longitudinal axes of the swivel links.

4. The swiveling handcuff of claim 1 wherein:

(a) the divider of each cuff has an outside edge;

(b) a bulb-shaped slot is formed in the divider, the bulb-shaped slot having an opening in the divider outside edge that is slightly wider than the swivel link neck, the opening having opposed sides; and (c) the opposed sides of the opening of the bulb-shaped slot define respective cutouts having a size substantially equal to the size of the swivel link neck.

5. Apparatus for restraining a person comprising:

(a) first and second generally planar cuffs having a divider between top and bottom plates, a bow pivotally connected to the plates, and a locking mechanism; and (b) at least one swivel link having first and second ends captured in the first and second cuffs, respectively, the swivel link providing three degrees of rotational freedom of the first and second cuffs relative to each other, wherein the swivel link comprises a pair of spherical lobes joined by a neck, and wherein:

the divider of each cuff is formed with a slot that receives a spherical lobe of the swivel link; and the top and bottom plates of each cuff are fabricated with respective slots extending completely therethrough and having a width slightly greater than the size of the swivel link neck, the top and bottom plates cooperating with the slot to capture the swivel link lobe in the slot, wherein:

there are first, second, and third swivel links connecting the first and second cuffs to each other, each swivel link defining a respective longitudinal axis;

the first and second cuffs are rotatable to a coplanar position whereat they are generally parallel to the longitudinal axes of the swivel links; and the first and second cuffs are rotatable relative to each other about the longitudinal axis of a selected swivel link through a total angle of approximately 30 degrees.

6. The apparatus of claim 5 wherein:

(a) there are first, second, and third swivel links connecting the first and second cuffs to each other, each swivel link defining a respective longitudinal axis;

(b) the first and second cuffs are rotatable to a coplanar position whereat they are generally parallel to the longitudinal axes of the swivel links; and (c) the first and second cuffs are rotatable relative to each other about the longitudinal axis of a selected swivel link through a total angle of approximately 30 degrees.

7. Apparatus for restraining a person comprising:

(a) first and second generally planar cuffs having a divider between top and bottom plates, a bow pivotally connected to the plates, and a locking mechanism; and (b) at least one swivel link having first and second ends captured in the first and second cuffs, respectively, the swivel link providing three degrees of rotational freedom of the first and second cuffs relative to each other, wherein the neck is cylindrical in shape, and wherein:

the divider of each cuff is formed with a slot that receives a spherical lobe and a portion of the neck of the swivel link;

the slot in the divider has an opening with opposed sides that are spaced apart a distance slightly greater than the diameter of the swivel link neck; and each side of the opening has an arcuate cutout having a radius substantially equal to the radius of the swivel link neck.

8. A swiveling handcuff that provides limited flexibility to the wrists of a first person in three degrees of rotational freedom comprising:

(a) at least two swivel links, each swivel link comprising first and second spherical ends connected by a neck;

(b) a first cuff comprising:

(i) a first divider that defines at least two bulb-shaped first slots therein sized to receive the first spherical ends of respective swivel links, and at least two openings sized to receive the necks of the respective swivel links, the first divider having an outside edge that defines an arcuate cutout on each side of each opening that is sized to receive a portion of the neck of the associated swivel link;

(ii) a pair of first plates that cooperate with the first divider to capture the swivel links in the first cuff, each first plate having a slot therethrough aligned with one of the first bulb-shaped slots; and (iii) bow means for cooperating with the first plates to releasably receive a first wrist of the first person; and (c) a second cuff comprising:

(i) a second divider that defines at least two bulb-shaped second slots therein sized to receive the second spherical ends of respective swivel links, and at least two openings sized to receive the necks of the respective swivel links, the second divider having an outside edge that defines an arcuate cutout on each side of each opening that is sized to receive a portion of the neck of the associated swivel link;

(ii) a pair of second plates that cooperate with the second divider to capture the swivel links in the second cuff, each second plate having a slot therethrough aligned with one of the second bulb-shaped slots; and (iii) bow means for cooperating with the second plates to releasably receive a second wrist of the first person, so that the swivel link necks can selectively enter the slots in the cuff plates and the arcuate cutouts in the dividers to thereby enable the cuffs to have limited three degrees of rotational freedom relative to each other.

* * * * *